US005885196A

United States Patent [19]

Gvoich

[11] Patent Number: 5,885,196

[45] Date of Patent: Mar. 23, 1999

[54] MULTIPLE ELASTIC CABLE EXERCISE DEVICE

[75] Inventor: Ned Gvoich, Scottsdale, Ariz.

[73] Assignee: Kordun, Ltd., Scottsdale, Ariz.

[21] Appl. No.: 755,732

[22] Filed: Nov. 25, 1996

[51] Int. Cl.[6] ..... A63B 21/02

[52] U.S. Cl. ..... 482/125; 482/122; 482/126

[58] Field of Search ..... 482/121, 122, 482/124, 125, 123, 126, 128, 129, 130

[56] References Cited

U.S. PATENT DOCUMENTS

| | | | |
|---|---|---|---|
| 652,617 | 6/1900 | Hotz | 482/126 |
| 904,339 | 11/1908 | Lievre | 482/125 |
| 1,998,226 | 4/1935 | Draheim . | |
| 3,256,015 | 6/1966 | Perrin . | |
| 4,019,734 | 4/1977 | Lee et al. | 482/125 |
| 4,059,265 | 11/1977 | Wieder et al. . | |
| 4,073,490 | 2/1978 | Feather | 482/129 |
| 4,326,708 | 4/1982 | Hinds . | |
| 4,591,150 | 5/1986 | Mosher | 482/125 |
| 4,645,204 | 2/1987 | Berger . | |
| 4,733,861 | 3/1988 | Plunkett, III . | |
| 4,733,862 | 3/1988 | Miller . | |
| 4,779,867 | 10/1988 | Hinds . | |
| 5,031,906 | 7/1991 | Jang . | |
| 5,125,649 | 6/1992 | Fuller . | |
| 5,131,650 | 7/1992 | Hall . | |
| 5,306,222 | 4/1994 | Wilkinson | 482/124 |
| 5,314,396 | 5/1994 | Parr . | |
| 5,334,122 | 8/1994 | Cole et al. | 482/121 |
| 5,431,610 | 7/1995 | Miller | 482/122 |
| 5,480,369 | 1/1996 | Dudley . | |
| 5,484,368 | 1/1996 | Chang | 482/125 |
| 5,496,245 | 3/1996 | Du Verney . | |
| 5,514,058 | 5/1996 | Buoni et al. . | |
| 5,549,532 | 8/1996 | Kropp | 482/122 |

*Primary Examiner*—Lyne A. Reichard
*Attorney, Agent, or Firm*—John D. Titus; Bryan Cave LLP

[57] ABSTRACT

An exercise device of the type employing an elastic cable to provide a restoring force comprises a handle attached to a plurality of elastic cables. The plurality of elastic cables are selectively attachable to a retainer assembly to provide a wide range of variation in restoring force exerted against the handle. The plurality of cables may also be enclosed in a flexible sheath to prevent the unattached, inactive cables from becoming entangled with each other or with the attached, active cables.

2 Claims, 3 Drawing Sheets

MULTIPLE ELASTIC CABLE EXERCISE DEVICE

BACKGROUND OF THE INVENTION

The present invention is related to manually operated muscle building exercise apparatus, specifically to apparatus that include a resilient elastic cable to provide resistance to motion. Such elastic cable exercise devices are particularly useful in that, as contrasted with barbells and dumbbells, a substantial resisting force can be generated by a relatively lightweight, portable device.

A principal drawback to elastic cable exercise devices, however, is the difficulty encountered in attempting to adjust the restoring force. Typically, the restoring force is adjusted by increasing or decreasing the free length of the elastic cable. For example, U.S. Pat. No. 4,779,867 to Hinds discloses an elastic cable exercise device comprising a cable having stirrups at each end and a bar that engages the central portion of the cable to provide a handle for the user to pull against the cable. Hinds discloses that the effective free length of the cable is adjusted by wrapping the cable about the ends of the bar. As noted in Hinds, however, wrapping the cable about the bar to shorten the effective length has an untoward side effect in that, in use, the cable exerts a torque on the bar and/or can slip off the end of the bar. Hinds therefore discloses an improvement comprising a pair of lugs at each end of the bar designed to retain the cable to prevent the wrapped cable from slipping over the ends of the bar during use and to prevent the cable from exerting a torque on the bar. Hinds does not, however, address the inherent limitations in the range of restoring force adjustments that can be made in such exercise devices employing a single cable.

Single cable elastic cable exercise devices suffer from an inherent limitation in the range of restoring force adjustment that can be made, because the only practical method for making adjustments is to shorten or lengthen the effective length of the cable. Elastic cables are similar to springs in that they exert a force that is proportional to displacement. Although elastic bands do not behave linearly, as do metallic springs, elastic bands can nevertheless be characterized as having an effective spring rate. Since, like a spring, an elastic cable exerts a force that is a function of displacement, elastic cable exercise devices do not exert a constant restoring force as do ordinary weight sets. Therefore, in order to simulate as closely as possible the constant force exerted by an ordinary weight set, elastic cable exercise devices are typically operated in such a way that the tensioned length of the cable changes by the minimum percentage possible over the full range of the exercise. A constant force is most nearly simulated using the a long cable (of low spring rate) stretched initially to provide the desired preload, which is then exercised over a short stroke. Obviously, this arrangement is not feasible in many instances.

Shortening or lengthening the effective length of the elastic cable to adjust the preload can accomplish only a very limited variation in the restoring force because the preloaded cable must still have sufficient reserve stretch to extend through the full range of motion of the particular exercise. Beyond a certain point, typically about 300% or so, a latex cable exhibits a rapid increase in its effective spring rate. Accordingly, if a large reduction in the free length of the cable is attempted to achieve a substantial increase in preload, the result will be a cable that cannot be stretched through the full range of motion necessary to perform the exercise. Thus, to accommodate a full range of potential users, manufacturers of single cable elastic cable exercise devices must provide a selection of interchangeable cables of different effective spring rates, with the concomitant increase in cost, and decrease in ease of use.

SUMMARY OF THE INVENTION

The present invention is an improvement over the prior art devices in that it includes, in a single apparatus, a plurality of elastic cables that can be selectively engaged to provide a substantially wider range of resistance than is possible with a single cable apparatus. In one embodiment, a flexible sleeve surrounds the plurality of cables to retain the cables that are not currently in use, thereby preventing the inactive cables from becoming entangled with each other or with the active cables. In another embodiment a handle assembly operatively attached to the plurality of elastic cables includes a hollow cylindrical handle adapted to receive an exercise bar. By inserting opposite ends of the exercise bar into a pair of handle assemblies, the individual handle assemblies are converted into a single exercise bar assembly.

BRIEF DESCRIPTION OF THE DRAWING

The present invention will be better understood from a reading of the ensuing detailed description, taken in conjunction with the accompanying drawing in which like references designate like elements and, in which.

DETAILED DESCRIPTION

Figure 1:
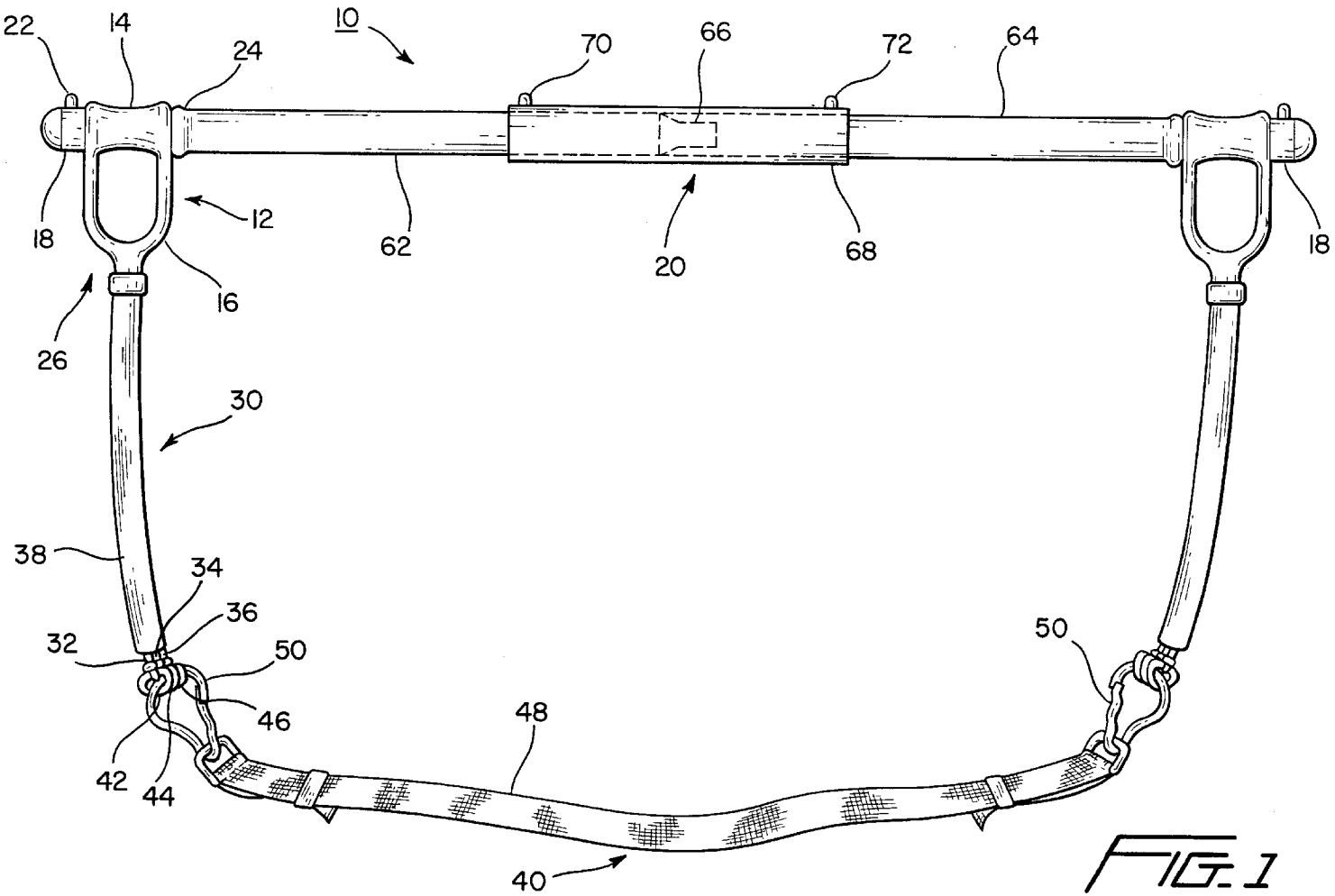
FIG. 1 is a plan view of an exercise device incorporating features of the present invention.

FIG. 1 illustrates an embodiment of an exercise device 10 incorporating features of the present invention. The exercise device 10 includes a stirrup-shaped handle assembly 12 comprising a grip 14 of hollow cylindrical cross section attached to a U-shaped bracket 16. The outer diameter of the grip 14 may be padded for comfort and the inner diameter of the grip 14 is sized to slidingly engage the outer diameter of an end 18 of an exercise bar 20 of generally tubular cross section. The handle 12 may be retained on the exercise bar 20 by conventional locking means such as a spring pin 22 located adjacent the end 18 of exercise bar 20. Exercise bar 20 includes an upset 24, snap ring (not shown), or similar feature to constrain handle 12 to a region adjacent the ends 18. Exercise bar 20 is collapsible into two halves 62 and 64. The left half 62 includes a tip 66 of reduced diameter to permit insertion of tip 66 into the end of right half 64. Conventional spring pins 70 and 72 retain the assembled halves 62 and 64 together by engaging holes in an outer sleeve 68. The outer sleeve 68 may also be padded for comfort.

Figures 2, 3:
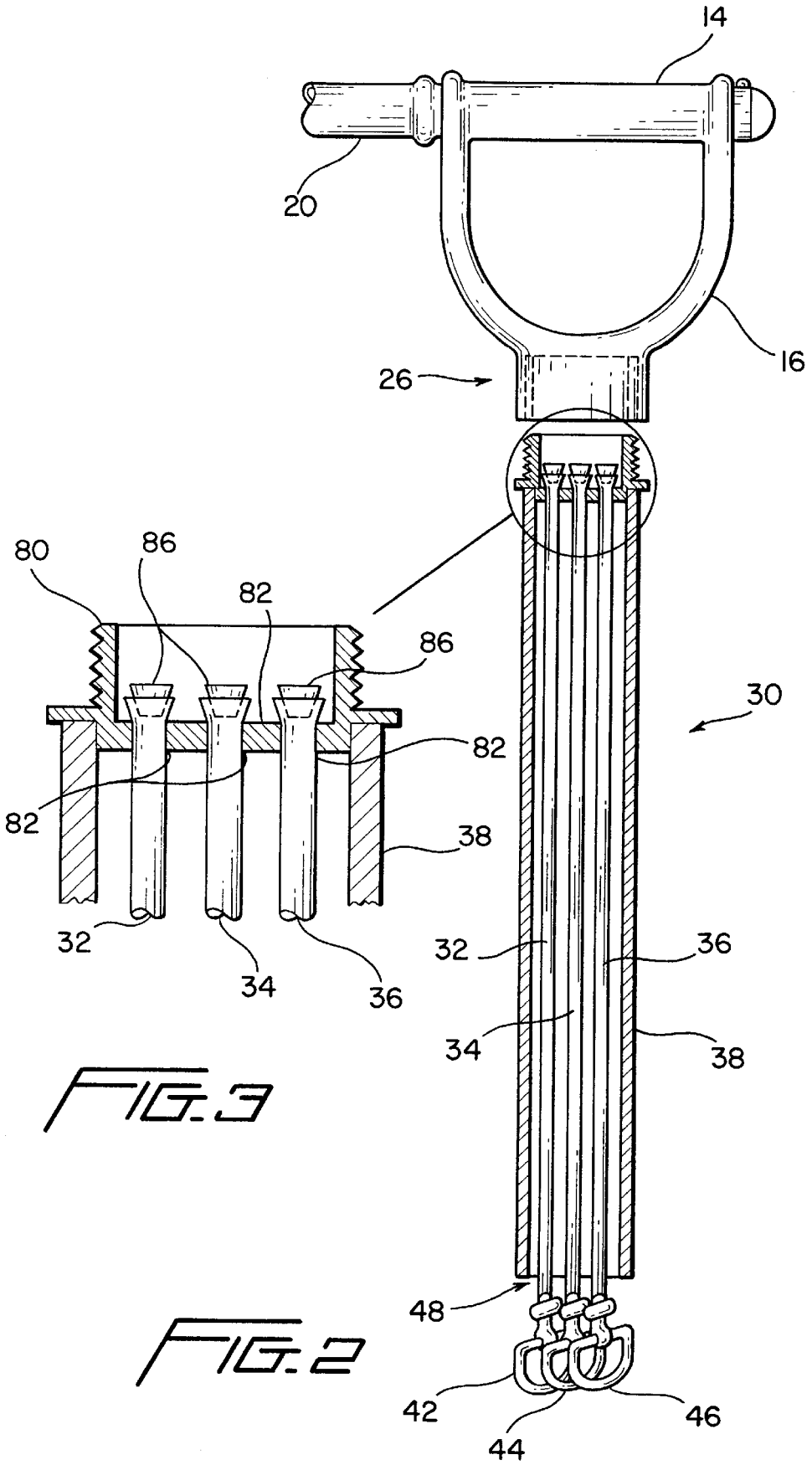
FIG. 2 is a partial plan view of the exercise device of FIG. 1.
FIG. 3 is an enlarged view of a portion of FIG. 2.

Referring to FIGS. 1 and 2, secured to and depending from the lower end 26 of bracket 16 is a resistance cartridge 30. Resistance cartridge 30 comprises elastic cables 32, 34 and 36 surrounded by a flexible sheath 38, which extends to cover substantially all of the untensioned length of cables 32, 34 and 36. The lower extremes of elastic cables 32, 34 and 36 terminate in "D" rings 42, 44, and 46 or other conventional fittings that are selectively attachable to a retainer assembly 40. The retainer assembly 40 holds the lower ends of the attached cables stationary such that when the handle 12 is moved, the attached cables are stretched to provide a restoring force. The inner diameter of the flexible sheath 38 is dimensioned such that the "D" rings 42, 44, and 46 will not easily pass through. Yet the inner diameter is not dimensioned so narrowly as to constrain the elastic cables themselves.

With reference to FIG. 3, the upper ends of the elastic cables 32, 34, and 36 are retained in plug 80 by inserting the ends of cables 32, 34, and 36 each through one of a plurality of corresponding holes 82 formed in the lower wall 84 of plug 80. A tapered plug 86 is then pressed into the end of each cable. The tapered plugs 86 expand the ends of cables 32, 34 and 36 to prevent the cables from pulling through the holes 82. Plug 80 is threaded into or otherwise attached by conventional means to the lower end 26 of handle 12. Plug 80 may also be integrally formed into handle 12. Sheath 38 is preferably pressed onto plug 80, but may also be retained by adhesive or other conventional means.

Figure 4:
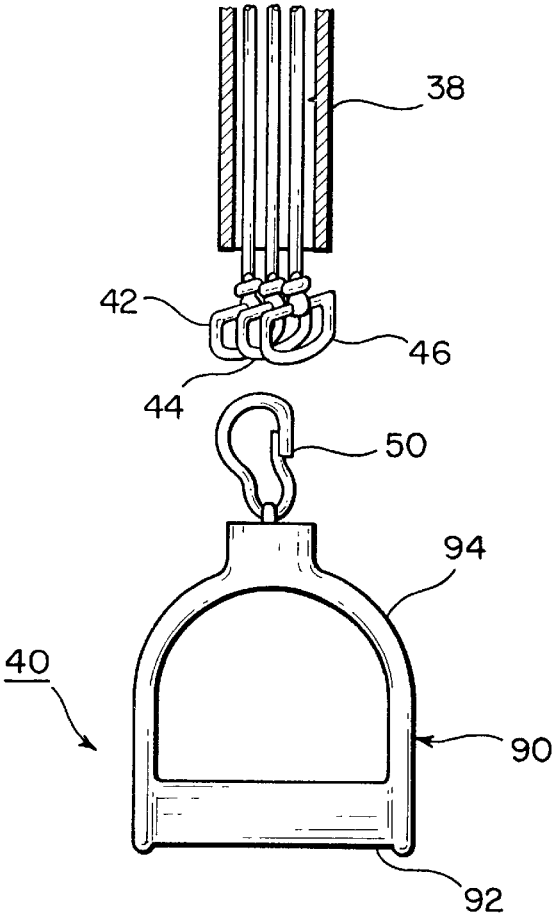
FIG. 4 is a plan view of another embodiment incorporating features of the present invention.

As shown in FIG. 1, an embodiment of retainer assembly 40 comprises a strap 48 terminating at each end in a clasp 50. Clasp 50 is capable of holding one or more of the "D" rings 42, 44, and 46. Strap 48 is adjustable to accommodated variations in height of the user, the desired static preload, and/or the particular exercise being performed. A second exercise assembly comprising a handle 12 and a resistance cartridge 30 are affixed to the opposite end of strap 48 by means of a second clasp 50 to provide a balanced tensile force in strap 48 during use. In an alternate embodiment shown in FIG. 4, retainer assembly 40 comprises a stirrup 90 consisting of a handle 92 attached to a U-shaped bracket 94 terminating at a clasp 50. Stirrup 90 is dimensioned so as to be capable of being retained either by a user's foot ( e.g. when performing individual curls) or by a user's hand (e.g. when performing a back fly exercise).

Figure 5:
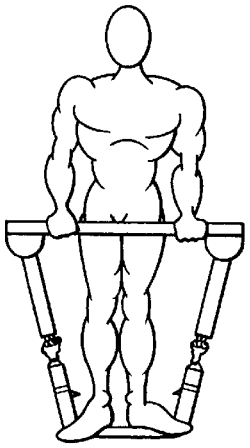
FIGS. 5–8 are illustrations of a user performing exercises using an exercise device incorporating features of the present invention.
Figure 6:
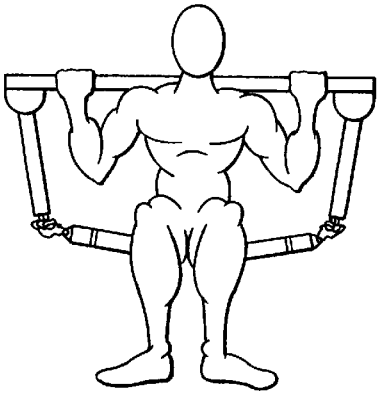
Figure 8:
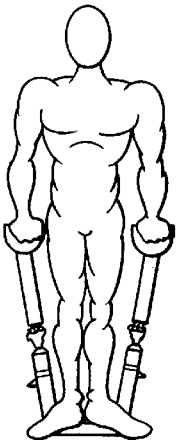
Figure 7:
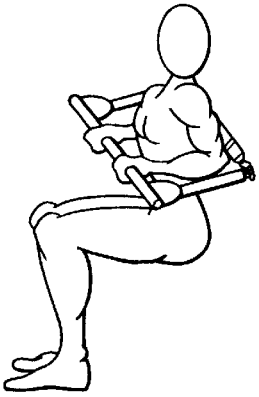

With reference to FIGS. 5, 6, and 7, in operation, the user selects the number of cables to attach to the retainer for a particular exercise and positions the apparatus. For example, if standing forearm curls are to be performed, the user positions the exercise bar at waist level and stands on the strap 48. If fewer than all of the elastic cables are selected for a particular exercise, the unattached "D" rings dangle immediately outside, or in some cases are lightly urged by the cable against, the open end 48 of sheath 38. Thus constrained by sheath 38, the unattached cables are prevented from becoming tangled with the active cables and/or striking the user as the exercise is performed. This is especially helpful where the resistance cartridge is oriented other than vertical, such as when performing a chest press exercise as shown in FIG. 7. Because the handles 12 rotatably engage the exercise bar 20 the elastic cables cannot exert a torque on the bar even if the bar itself is rotated through a substantial arc. Thus, for those exercises where the bar naturally rotates, such as biceps curls, an exercise device according to the present invention more naturally simulates the torque-free force exerted by a weight set. Individual arm exercises can be performed simply by sliding the handles off the exercise bar as shown in FIG. 8. Preferably, the effective spring rates of the elastic cables are different from each other, thereby providing N-factorial plus 1 possible composite spring rates. For example where cables 32, 34, and 36 are of different spring rates K32, K34 and K36, respectively, 7 possible composite spring rates are possible (i.e. K(composite)=K32; K34; K36; K32+K34; K32+K36; K34+K36; or K32+K34+K36).

Although certain preferred embodiments and methods have been disclosed herein, it will be apparent from the foregoing disclosure to those skilled in the art that variations and modifications of such embodiments and methods may be made without departing from the true spirit and scope of the invention. For example, although three cables are shown in the embodiment of FIG. 2, any number of cables in excess of one is considered to be within the scope of the present invention. Accordingly, it is intended that the invention shall be limited only to the extent required by the appended claims and the rules and principles of applicable law.

What is claimed is:

1. An exercise apparatus comprising:

a handle;

a resistance cartridge;

a retainer assembly adapted to be held by a user's foot;

said resistance cartridge comprising:

a plurality of elastic cables of unequal spring rates, each of said plurality of elastic cables having a fixed end, a free end and a longitudinal axis, said fixed ends being attached to said handle and said free ends terminating in a plurality of fasteners selectively attachable to said retainer assembly, a hollow flexible sheath attached to said handle extending from said handle toward said free ends so as to surround at least a portion of the length of said plurality of elastic cables, for preventing said cables from entangling one with another;

an end plug disposed in said handle, said end plug having a plurality of holes therethrough, said holes including a tapered portion for retaining said plurality of elastic cables; and a plurality of tapered plugs, said tapered plugs inserted into said fixed ends of each of said plurality of elastic cables, said tapered plugs adapted to expand each of said fixed ends of said plurality of elastic cables to a size larger than a corresponding one of said plurality of holes.

2. An exercise apparatus comprising:

a pair of handles;

a pair of resistance cartridges;

a retainer assembly adapted to be held by a user's foot;

said resistance cartridges each comprising:

a plurality of elastic cables of unequal spring rates, each of said plurality of elastic cables having a fixed end, a free end and a longitudinal axis, said fixed ends each being attached to one of said pair of handles and said free ends terminating in a plurality of fasteners for selectively attaching said free ends to said retainer assembly, said fasteners each having a dimension transverse to said longitudinal axis, a hollow flexible sheath attached to said handle extending from one of said pair of handles toward said free ends so as to surround at least a portion of the length of said plurality of elastic cables;

an end plug disposed in said handle, said end plug having a plurality of holes therethrough, said holes including a tapered portion for retaining said plurality of elastic cables; and a plurality of tapered plugs, said tapered plugs inserted into said fixed ends of each of said plurality of elastic cables, said tapered plugs adapted to expand each of said fixed ends of said plurality of elastic cables to a size larger than a corresponding one of said plurality of holes.

* * * * *